United States Patent [19]

Theurer et al.

[11] Patent Number: 4,538,686

[45] Date of Patent: Sep. 3, 1985

[54] BALLAST CLEANING MACHINE

[75] Inventors: Josef Theurer, Vienna; Karl Fölser, Linz, both of Austria

[73] Assignee: Franz Plasser Bahnbaumaschinen-Industriegesellschaft m.b.H., Vienna, Austria

[21] Appl. No.: 487,530

[22] Filed: Apr. 22, 1983

[30] Foreign Application Priority Data

Aug. 17, 1982 [AT] Austria ..... 3127/82

[51] Int. Cl.[3] ..... E01B 27/00

[52] U.S. Cl. ..... 171/16; 172/40

[58] Field of Search ..... 171/16; 37/104, 107; 172/32, 33, 40; 104/7 R

[56] References Cited

U.S. PATENT DOCUMENTS

| | | | |
|---|---|---|---|
| 3,638,339 | 2/1972 | Vik | 172/40 X |
| 4,245,703 | 1/1981 | Theurer et al. | 171/16 |
| 4,267,777 | 5/1981 | Theurer et al. | 171/16 X |

*Primary Examiner*—Richard T. Stouffer
*Attorney, Agent, or Firm*—Kurt Kelman

[57] ABSTRACT

In a self-propelled ballast cleaning machine which comprises a ballast excavating chain having an output, a hydraulic drive for moving the ballast excavating chain, a ballast screening and storing device arranged to receive the excavated ballast from the output for separating the excavated ballast into waste and cleaned ballast and for storing the cleaned ballast, and a hydraulic vibrating drive for imparting vibrations to the ballast screening and storing device, a control arrangement operates the hydraulic drives, the control arrangement including a control element having an input and an output, the input of the control element being connected to the chain moving drive and the output of the control element being connected to the vibrating drive for changing the frequency of the vibrations imparted to the ballast screening and storing device analogously to a respective setting of the control element for storing the ballast in the device.

3 Claims, 2 Drawing Figures

BALLAST CLEANING MACHINE

Figure 1:
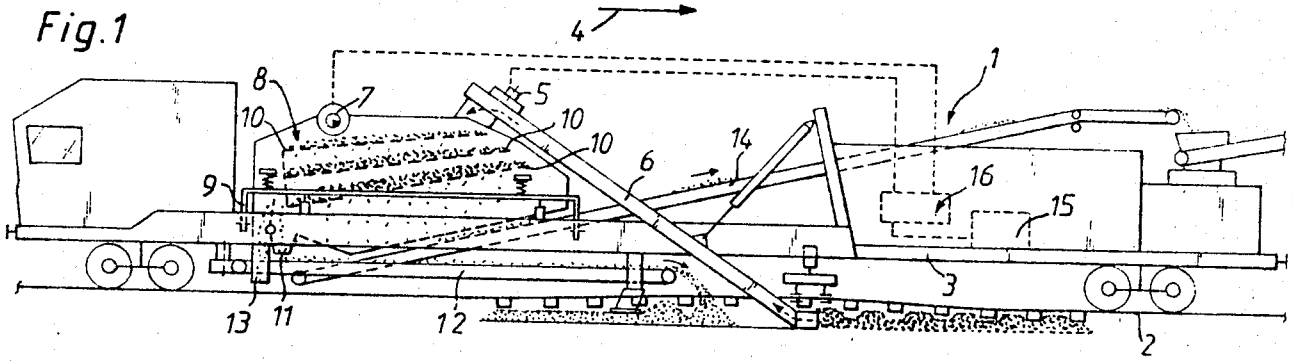

The present invention relates to a self-propelled ballast cleaning machine comprising a ballast excavating chain having an output, a hydraulic drive for moving the ballast excavating chain, a ballast screening and storing device arranged to receive the excavated ballast from the output for separating the excavated ballast into waste and cleaned ballast and for storing the cleaned ballast, a hydraulic vibrating drive for imparting vibrations to the ballast screening and storing device, and conveyor means for respectively receiving the waste and the cleaned ballast from the ballast screening and storing device, for redistributing the cleaned ballast and for removing the waste. This invention also provides an improved ballast cleaning method.

Our U.S. Pat. No. 4,245,703, dated Jan. 20, 1981, discloses such a machine wherein a housing wall of the screening device at the outlet side has a pivotal closure which is remotely controlled by the forward drive of the machine to enable the screening device housing to be used for storing the ballast. The closure control is also connected to the vibrating drive to enable the same to be stopped when the closure is pivoted closed. This prevents disadvantageous accumulations of stored ballast when the forward drive of the machine is interrupted for a short time but it requires a pivotal closure which is prone to malfunction.

It is the primary object of this invention to provide a ballast cleaning machine of the first-indicated type with simple means for assuring a proper intermediate storage of the cleaned ballast in the ballast screening and storing device.

The above and other objects are accomplished according to one aspect of the invention with a control arrangement for operating the hydraulic drives and which includes a control element having an input and an output, the input of the control element being connected to the chain moving drive and the output of the control element being connected to the vibrating drive for changing the frequency of the vibrations imparted to the ballast screening and storing device analogously to a respective setting of the control element for storing the ballast in the device.

With this control arrangement, a simple and inexpensive control element couples the chain moving and vibrating drives together so that the ballast storage will become effective immediately upon interruption of the ballast delivery to the ballast screening and storing device. No special and additional structure is required in a conventional screening device if it is to be retrofitted for storing. With the control arrangement of the invention, the frequency of vibrations may be reduced when no excavated ballast is fed to the screening and storing device, thus reducing wear on the screening means and extending its operating life. Furthermore, the temporary reduction of the vibration frequency and stoppage of the chain movement produces a considerable energy saving and diminishes the noise. The direct connection of the control element to the vibrating drive also enables the frequency of the vibrations to be increased instantaneously as the movement of the excavating chain is resumed so that proper cleaning of the ballast is assured.

Accordingly, the ballast is cleaned by excavating the ballast with a moving excavating chain, moving the excavated ballast on the moving chain to a ballast screening and storing device including screening means for separating the excavated ballast into waste and cleaned ballast and for storing the cleaned ballast on the screening means, vibrating the screening and storing means for imparting vibrations thereto, reducing the frequency of vibrations when the moving excavating chain is stopped for a short time to interrupt movement of the excavated ballast to the ballast and screening device whereby the ballast is stored on the screening means, subsequently increasing the frequency of vibrations to a maximum when the movement of the excavated ballast on the chain is resumed for effectively separating the excavated ballast into waste and cleaned ballast, and redistributing the cleaned ballast.

This method assures a continuously homogenous cleaned ballast bed, regardless of operational interruptions, stoppages from time to time or different forward speeds of the machine. By storing the cleaned ballast directly in the screening device, this storage can be assured automatically in immediate response to any interruption of the delivery of the excavated ballast and totally independently of the experience and/or attention of the machine operator. Furthermore, when the excavating chain movement is resumed and without any time lapse, the ballast is immediately and forcefully screened and the cleaned ballast is received from the screening and storing device by the conveyor means for redistribution so that the operation will proceed automatically without requiring the attention of an operator.

Figure 2:
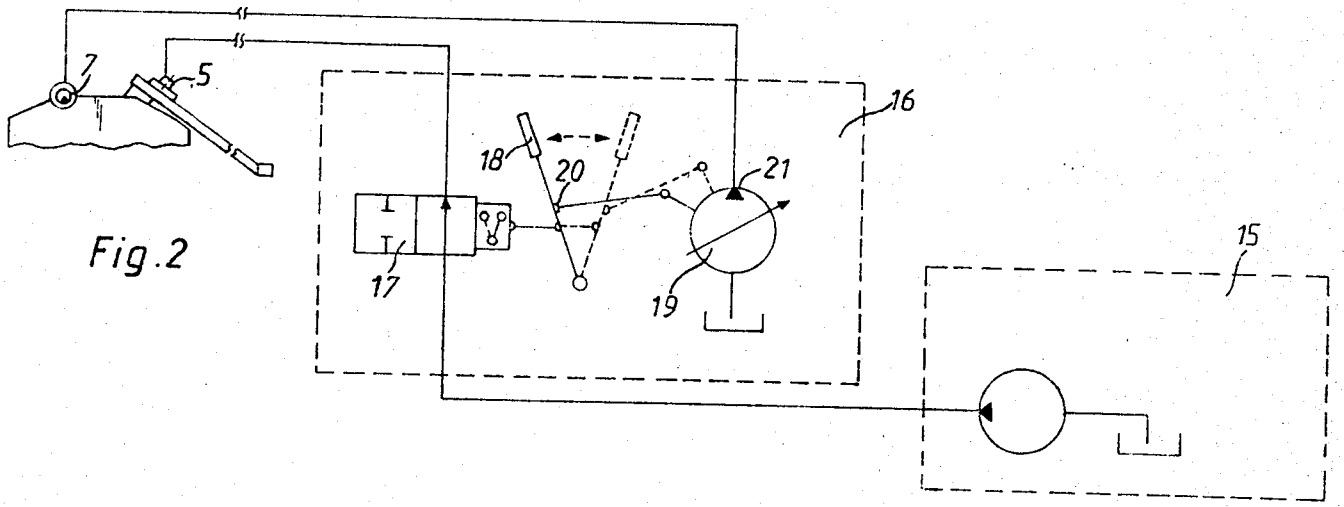

The above and other objects, advantages and features of the present invention will become more apparent from the following detailed description of a now preferred embodiment thereof, taken in conjunction with the somewhat diagrammatic drawing wherein FIG. 1 is a side elevational view of a ballast cleaning machine with the control arrangement of this invention; and FIG. 2 is a circuit diagram of the control arrangement.

Referring now to the drawing and first to FIG. 1, there is shown self-propelled ballast cleaning machine 1 comprising frame 3 mounted on two swivel trucks on which the machine is moved along track 2 in an operating direction indicated by arrow 4. As is conventional, a track lifting unit is mounted on machine frame 3 for raising the track where the ballast is to be excavated by endless ballast excavating chain 6 which is moved by hydraulic drive 5 for excavating the ballast under the track and delivering the excavated ballast to ballast screening and storing device 8 arranged to receive the excavated ballast from an output at the apex of the excavating chain for separating the excavated ballast into waste and cleaned ballast and for storing the cleaned ballast. Hydraulic vibrating drive 7 imparts vibrations to the ballast screening and storing device. Four heavy coil springs mount ballast screening and storing device 8 for free vibration on support frame 9 which is mounted on machine frame 3 and the ballast screening and storing device is pivotal with respect to the machine frame about an axis extending in the direction of track elongation. This enables heavy ballast screening and storing device 8 to be adjusted into a horizontal position at a point of track superelevation. Vibrating drive 7 has eccentric balancing weights rotating in opposite directions for imparting linear oscillations to device 8. The ballast screening and storing device has ballast screening means illustrated as three superposed screens 10 comprised of tensioned rubber sieves of different mesh sizes for separating the excavated ballast into waste and cleaned ballast and for storing the cleaned ballast. Outlet chutes 11 are arranged at each side of the ballast screening and storing device. Conveyor means is arranged on the machine for respectively receiving the waste and the cleaned ballast from the ballast screening and storing device, for redistributing the cleaned ballast and for removing the waste. The illustrated conveyor means comprises a respective conveyor band 12 having an input end under a repective outlet chute 11 for receiving the cleaned ballast therefrom. Each conveyor band is mounted on machine frame 3 for pivoting about a vertical axis so as to sweep the output end of the conveyor band opposite to the input end over substantially half of the track area for redistributing the cleaned ballast near the point of excavation. The conveyor means further comprises conveyor 14 having an input end below ballast screening and storing device 8 for receiving the waste therefrom. Conveyor 14 extends partially between conveyor bands 12 associated with the respective rails of the track and rises to an output end thereof whence the waste is thrown into a hopper for further disposal or to the shoulders of the track, all in a conventional manner. Furthermore, a conventional ballast planing device is shown to be mounted on machine frame 3 rearwardly of the output ends of conveyor bands 12 for smoothing the redistributed cleaned ballast.

The control arrangement of this invention is shown in the enlarged diagram of FIG. 2. As schematically illustrated, a hydraulic fluid supply source 15 for chain moving drive 5 and vibrating drive 7 is connected to the drives, this source comprising a hydraulic fluid sump and a fluid delivery pump connected in the hydraulic circuit to supply hydraulic fluid from the sump to chain moving drive 5. Control arrangement 16 is arranged in the hydraulic circuit between the fluid delivery pump and drives 5 and 7, and this arrangement comprises two-way valve 17 mounted in the supply conduit delivering the hydraulic fluid from the pump to drive 5. The two-way valve is operated by control lever 18 and this lever is connected to control element 19 mounted in the supply conduit delivering the hydraulic fluid to drive 7. The control element has input 20 and output 21. The illustrated control element is a steplessly adjustable pump controlling the flow of hydraulic fluid from a sump to the vibrating drive. The pump may be a rotary pump having 1150–1350 rpm. Such a steplessly adjustable pump will provide a particularly simple and stepless control particularly suitable for conventional vibrating drives for steplessly changing the rotary speed of the vibrating drive and, thus, the frequency of vibrations imparted thereby. As shown, input 20 of control element 19 is connected to chain moving drive 5 by way of its actuating valve and output 21 is connected to vibrating drive 7 for changing the frequency of the vibrations imparted to the ballast screening and storing device analogously to a respective setting of the control element for storing the ballast in device 8. When control element 19 is arranged to reduce the frequency of the vibrations to at least about one third of a maximum frequency of vibrations when chain moving drive 5 is operated to stop movement of the chain, the frequency range of vibrations will enable the ballast deposited on screens 10 to follow the vibrations without being displaced and thus to be stored thereon. On the other hand, the frequency of the vibrations is still sufficient to enable the very heavy screening and storing device to overcome the inertia of its great mass rapidly and to be much more rapidly vibrated immediately upon resumption of the excavating chain movement so that the stored excavated ballast may be efficiently cleaned on the screen vibrated at a high frequency for separating the waste from the cleaned ballast.

Ballast cleaning machine 1 may be operated in the following manner for cleaning the ballast:

During normal operation, the machine is continuously advanced along track 2 in operating direction 4 and hydraulic drive 5 is operated to move excavating chain 6 to excavate the ballast while vibrating drive 7 imparts a maximum frequency of vibrations to ballast screening and storing device 8 which oscillates on its coil springs in the direction of the longitudinal extension of the machine. The excavated ballast is moved on the moving chain to ballast screening and storing device 8 and thrown from the excavating chain onto uppermost screen 10, ballast of a size exceeding the mesh size of this screen is retained thereon while the vibrations imparted to the screen cause material below this size to fall through the openings in the screen to intermediate screen 10 therebelow. This operation is repeated there and material below the size of the openings in the intermediate screen falls onto the lowest screen 10. The waste separated from the cleaned ballast on the lowest screen passes through outlet chutes 13 to removal conveyor 14 while the cleaned ballast passes through outlet chutes 11 to redistributing conveyor bands 12.

When the operator throws operating lever 18 into the position shown in FIG. 2 in broken lines, two-way valve 17 is actuated to interrupt the flow of hydraulic fluid to chain moving drive 5 so as to stop movement of ballast excavating chain 6. This may be required, for example, when the forward movement of the machine has to be temporarily discontinued. As the operating lever is thus moved by the operator, input 20 of control element 19 is also moved into the position shown in broken lines. This causes the rotary speed of control pump to be reduced, for instance by about two thirds, so that the output of vibrating drive 7 is correspondingly reduced to reduce the frequency of vibrations imparted to the ballast screening and storing device, causing the ballast in this device to be stored on the screening means because it is no longer shaken through the openings in screens 10. Thus, as soon as excavating chain 6 stops moving, the ballast is stored in device 8. This avoids any accumulation of cleaned ballast in the range of the output end of conveyor bands 12 during a temporary halt in the ballast excavating operation. Any ballast falling through the large openings of the upper screen 10 will be stored on the screen therebelow, which has smaller openings. In other words, when the movement of the excavated ballast is interrupted for a short time, the frequency of vibrations imparted to device 8 is reduced sufficiently to permit the ballast in the device to be stored therein. Subsequently, when the movement of the excavated ballast on chain 6 is resumed, i.e. operating lever 18 is thrown back into the position shown in full lines, the frequency of vibrations is increased to a maximum for effectively separating the excavated ballast into waste and cleaned ballast, and to enable the cleaned ballast coming from screening and storing device 8 to be redistributed by conveyor bands 12.

What is claimed is:

1. A self-propelled ballast cleaning machine comprising (a) a ballast excavating chain having an output, (b) a hydraulic drive for moving the ballast excavating chain, (c) a ballast screening and storing device arranged to receive the excavated ballast from the output for separating the excavated ballast into waste and cleaned ballast and for storing the cleaned ballast, (d) a hydraulic vibrating drive for imparting vibrations to the ballast screening and storing device, (e) a control arrangement for operating the hydraulic drives, the control arrangement including a control element having an input and an output, the input of the control element being connected to the chain moving drive and the output of the control element being connected to the vibrating drive for changing the frequency of the vibrations imparted to the ballast screening and storing device analogously to a respective setting of the control element for storing the ballast in the device, and (f) conveyor means for respectively receiving the waste and the cleaned ballast from the ballast screening and storing device, for redistributing the cleaned ballast and for removing the waste.

2. The self-propelled ballast cleaning machine of claim 1, wherein the control element is a steplessly adjustable pump controlling the flow of hydraulic fluid to the vibrating drive.

3. The self-propelled ballast cleaning machine of claim 1, wherein the control element is arranged to reduce the frequency of the vibrations to at least about one third of a maximum frequency of vibrations when the chain moving drive is operated to stop movement of the chain.

* * * * *